US012808550B2

(12) United States Patent
Rehm et al.

(10) Patent No.: US 12,808,550 B2
(45) Date of Patent: Nov. 24, 2026

(54) OVEN WITH HEAT MANAGEMENT SYSTEM

(71) Applicant: REHM BRANDS, INC., West Bend, WI (US)

(72) Inventors: David Rehm, West Bend, WI (US); Shannon Medd, West Bend, WI (US); Isaiah Potvin, West Bend, WI (US)

(73) Assignee: REHM BRANDS, INC., West Bend, WI (US)

( * ) Notice: Subject to any disclaimer, the term of this patent is extended or adjusted under 35 U.S.C. 154(b) by 347 days.

(21) Appl. No.: 18/568,665

(22) PCT Filed: Jun. 10, 2022

(86) PCT No.: PCT/US2022/033046
§ 371 (c)(1),
(2) Date: Dec. 8, 2023

(87) PCT Pub. No.: WO2022/261460
PCT Pub. Date: Dec. 15, 2022

(65) Prior Publication Data

US 2024/0302055 A1 Sep. 12, 2024

Related U.S. Application Data

(60) Provisional application No. 63/209,840, filed on Jun. 11, 2021.

(51) Int. Cl.
*F24C 15/34* (2006.01)
*F24C 15/00* (2006.01)

(52) U.S. Cl.
CPC ..... *F24C 15/34* (2013.01); *F24C 15/006* (2013.01)

(58) Field of Classification Search
CPC .... F24C 15/34; F24C 15/006; F27B 17/0016; F27D 9/00
See application file for complete search history.

(56) References Cited

U.S. PATENT DOCUMENTS 3,384,067 A * 5/1968 Rawald ..... F24C 14/02 126/299 R
3,889,100 A * 6/1975 Dills ..... F24C 15/006 219/393
4,071,739 A * 1/1978 Jenn ..... F24C 15/2042 219/393
4,654,508 A * 3/1987 Logel ..... F24C 15/006 219/400

(Continued)

FOREIGN PATENT DOCUMENTS

EP 0995952 A2 4/2000
WO WO-2018160579 A1 * 9/2018 ..... A21B 1/24

OTHER PUBLICATIONS

PCT Search Report dated Oct. 26, 2022 in connection with PCT/US2022/033046, 5 pgs.

(Continued)

*Primary Examiner* — Jesse S Bogue
(74) *Attorney, Agent, or Firm* — Quarles & Brady LLP

(57) ABSTRACT

An oven or kiln includes a fan or blower system that provides air to a plenum between the oven core and an outer housing. Vents in the housing aid in directing airflow around the plenum to maintain an outer surface of the oven close to ambient temperature.

20 Claims, 16 Drawing Sheets

(56) References Cited

U.S. PATENT DOCUMENTS

| | | | | |
|---|---|---|---|---|
| 4,832,000 | A * | 5/1989 | Lamppa | F24B 5/026 126/77 |
| 5,927,265 | A | 7/1999 | McKee et al. | |
| 6,227,189 | B1 | 5/2001 | Dougherty | |
| 7,708,007 | B2 * | 5/2010 | Kim | F24C 15/006 126/193 |
| 7,874,289 | B2 * | 1/2011 | Larsen | F24C 15/04 126/21 R |
| 10,598,391 | B2 * | 3/2020 | Padula | F24C 15/322 |
| 2006/0060186 | A1 * | 3/2006 | Cothran | F24C 7/087 126/273 R |
| 2007/0295322 | A1 * | 12/2007 | Dobie | F24C 15/325 126/21 A |
| 2010/0139640 | A1 * | 6/2010 | Watkins | F24C 15/006 126/21 A |
| 2017/0082296 | A1 * | 3/2017 | Jeong | F24C 15/28 |
| 2018/0073742 | A1 * | 3/2018 | Kim | F24C 15/005 |
| 2019/0316380 | A1 * | 10/2019 | Kim | E05F 15/611 |
| 2020/0240646 | A1 | 7/2020 | Opdahl et al. | |

OTHER PUBLICATIONS

PCT Written Opinion dated Oct. 26, 2022 in connection with PCT/US2022/033046, 8 pgs.

* cited by examiner

OVEN WITH HEAT MANAGEMENT SYSTEM

CROSS-REFERENCE TO RELATED APPLICATIONS

This application claims priority to International Patent Application PCT/US2022/033046 filed Jun. 10 2022, which claims priority of U.S. provisional application Ser. No. 63/209,840 filed Jun. 11, 2021, both of which application are incorporated herein in their entirety for all purposes.

BACKGROUND

This disclosure is addressed to an oven or kiln that can be used in heating processes such as hardening, drying, chemical transformation, annealing, fusing, deforming, bonding, melting, calcification, pyrolysis, and cooking. Materials such as metal, ceramic, wood, glass, food, and other materials that can benefit from such processing.

Ovens and kilns providing heating processes for hardening, drying, chemical transformation, annealing, fusing, deforming, bonding, melting, calcification, pyrolysis, cooking, and processes are frequently used in industrial, commercial, and other settings. To prevent overheating of the environment, it can be important to maintain the heat within the oven itself, and to limit heating of the outer shell of the oven or kiln. The present disclosure addresses these and other issues.

SUMMARY

This disclosure describes In one aspect, the disclosure describes an oven comprising an outer housing; an oven core comprising an oven core housing, an interior insulation layer and a heating coil, the oven core received within the outer housing; a plenum between the outer housing and the oven core; a blower directing a cooling fluid flow into the plenum; a door including a central insulated panel and a door plenum between the central insulated panel and an outer edge, wherein the door is moveable between an open and a closed position, and wherein the central insulated panel encloses the oven core and the door plenum mates with the plenum between the outer housing and the oven core when in the closed position, the door including a vent provided at a position vertically opposite the blower, wherein fluid flow from the blower is directed through the plenum and out the door vent.

The insulator can be a ceramic insulator, and the outer housing and oven core can comprise stainless steel.

The oven can include a latch for latching the door to the outer housing, and the latch can include a cam style latching mechanism. The door can comprise a frame mounted to an inside of a vertical panel of the door, the perimeter of the frame being smaller than the perimeter of the outer housing, wherein a second plenum is formed that is continuous with the plenum formed between the outer housing and the oven core. Insulation can be provided in the frame of the door, and the insulation in the door can enclose the insulation in the oven core.

A blower vent can be provided in the aperture formed in an upper portion of a back wall of the housing. A vent can provided in a lower portion of the door, wherein air from the blower is directed from the back wall of the housing through the plenum and out the door, the vents dividing the air flow through the plenum along first and second sides of the housing. A plurality of vents can be placed in a first and a second side wall of the housing adjacent a top of the housing.

The oven may also include a controller in communication with the heating coil, the controller programmed to control the heating element with a proportional integral derivative control. A hood can me coupled to the housing, the hood including a horizontal flange extending above and substantially parallel with an upper surface of the housing and including an air vent opening; a vertical flange substantially parallel with and offset from a back surface of the housing; and a blower for expelling cooling fluid though the air vent.

In another aspect of the disclosure, an oven is disclosed comprising an outer housing including a back wall and at least one side wall extending from and defining an outer perimeter around the back wall, an aperture formed in the back wall; an oven core housing received in the outer housing, the oven core housing having a back wall and at least one side wall coupled to and extending from the back wall, the at least one side wall defining a perimeter around the back wall that is smaller than the perimeter of the outer housing, wherein a plenum is defined between the outer housing and the oven core housing, and at least a portion of the aperture formed in the back wall of the outer housing is positioned in the plenum; a blower coupled to the outer housing adjacent the aperture, the blower providing a fluid flow to the plenum; an insulating layer received in the oven core housing, the insulator comprising at least one side wall extending along and insulating the at least one side wall of the oven core housing and a back wall extending along and insulating the back wall of the oven core housing, the at least one side wall a portion of the insulator extending beyond the at least one side wall of the oven core at an edge opposite the back wall of the oven core; a heating coil received on an interior surface of the insulating layer; and a door movably coupled to the at least one side wall of the outer housing opposite the back wall, the door configured to move between an open position providing access to an interior of the oven core housing and a closed position preventing access to the interior of the oven core housing, wherein in the closed position, the portion of the ceramic insulator extending beyond the at least one side wall of the oven core abuts the door to insulate the oven, the door including a plurality of air vents in a lower portion of the door, wherein fluid flow from the blower is directed through the plenum to the air vents in the door.

The oven can include first and second side walls and each of the first and second side walls include air vents in an upper portion and a lower portion of the side wall, the air vents in fluid communication with the plenum. The side vents can be located adjacent the door when the door is in a closed position. The oven can include a controller in a controller housing, and the controller housing can comprises an air vent.

An another aspect of the disclosure, an oven is disclosed comprising an outer housing; an oven core comprising an oven core housing, an interior insulation layer and a heating element, the oven core received within the outer housing; a plenum between the outer housing and the oven core; a blower directing a cooling fluid flow into the plenum; a door including a central insulated panel and a door plenum between the central insulated panel and an outer edge, wherein the door is moveable between an open and a closed position, and wherein the central insulated panel encloses the oven core and the door plenum mates with the plenum between the outer housing and the oven core when in the closed position, the door including a vent provided at a position vertically opposite the blower, wherein air flow from the blower is directed through the door vent and through the plenum; an air hood coupled to the housing, the air hood including: a horizontal flange extending above and substantially parallel with an upper surface of the housing and including an air vent opening; and a vertical flange coupled to the horizontal flange and substantially parallel with and offset from a back surface of the housing; and a controller in communication with the blower and the heating element, the controller maintaining a temperature of the housing by monitoring a temperature of the oven and applying a proportional-integral-derivative control to the heating element.

The oven can include a plurality of vents formed adjacent the plenum, the plurality of vents positioned to direct air flow in the plenum. A latch with a cam mechanism can couple the door to the housing.

These and other aspects of the disclosure will become apparent from the following description. In the description, reference is made to the accompanying drawings which form a part hereof, and in which there is shown a preferred embodiment of the invention. Such embodiment does not necessarily represent the full scope of the disclosure and reference is made therefore, to the claims herein for interpreting the scope of the disclosure.

DESCRIPTION

Figure 1:
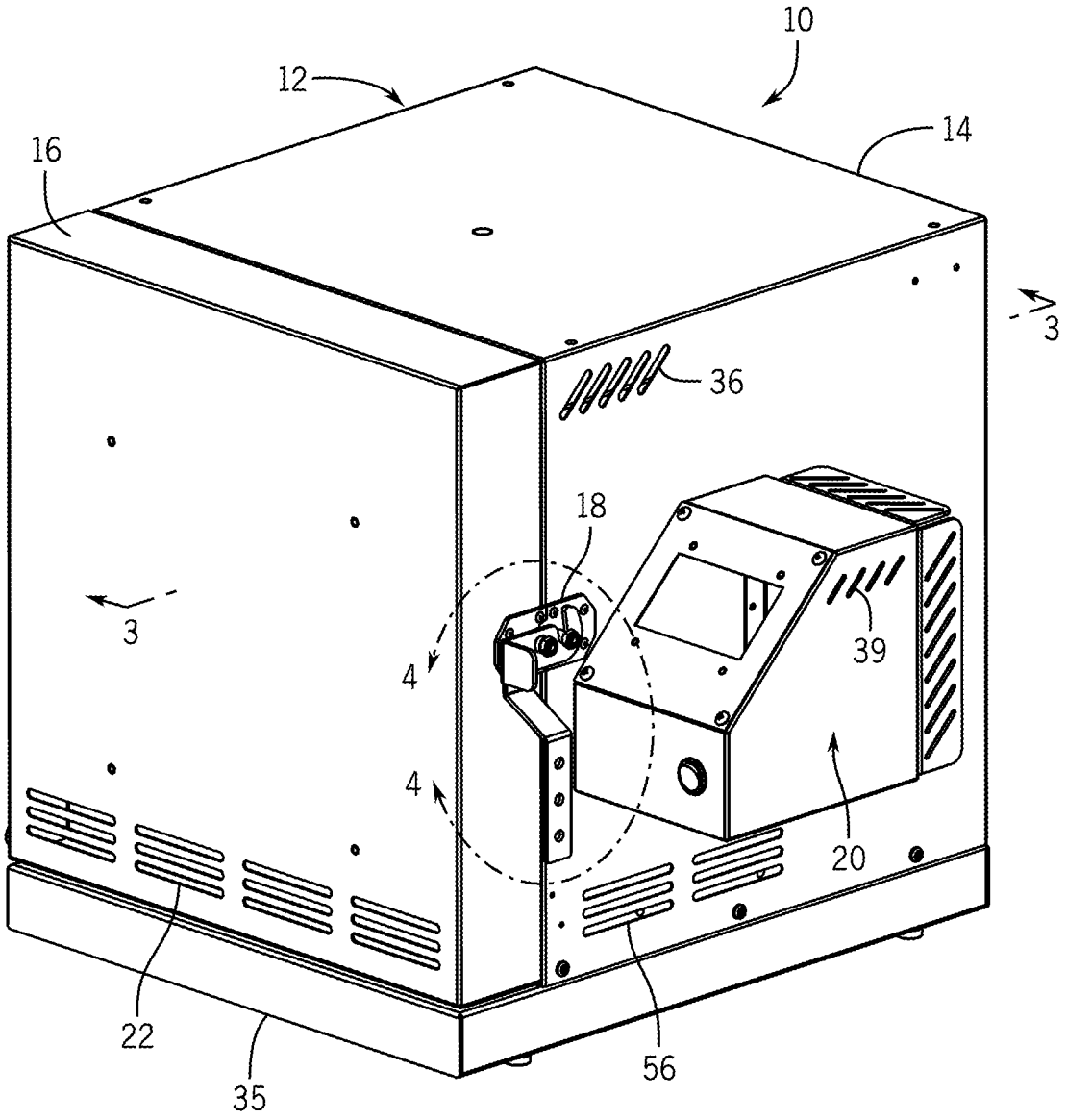
FIG. 1 is a front perspective view of an oven or kiln constructed in accordance with the disclosure.
Figure 2:
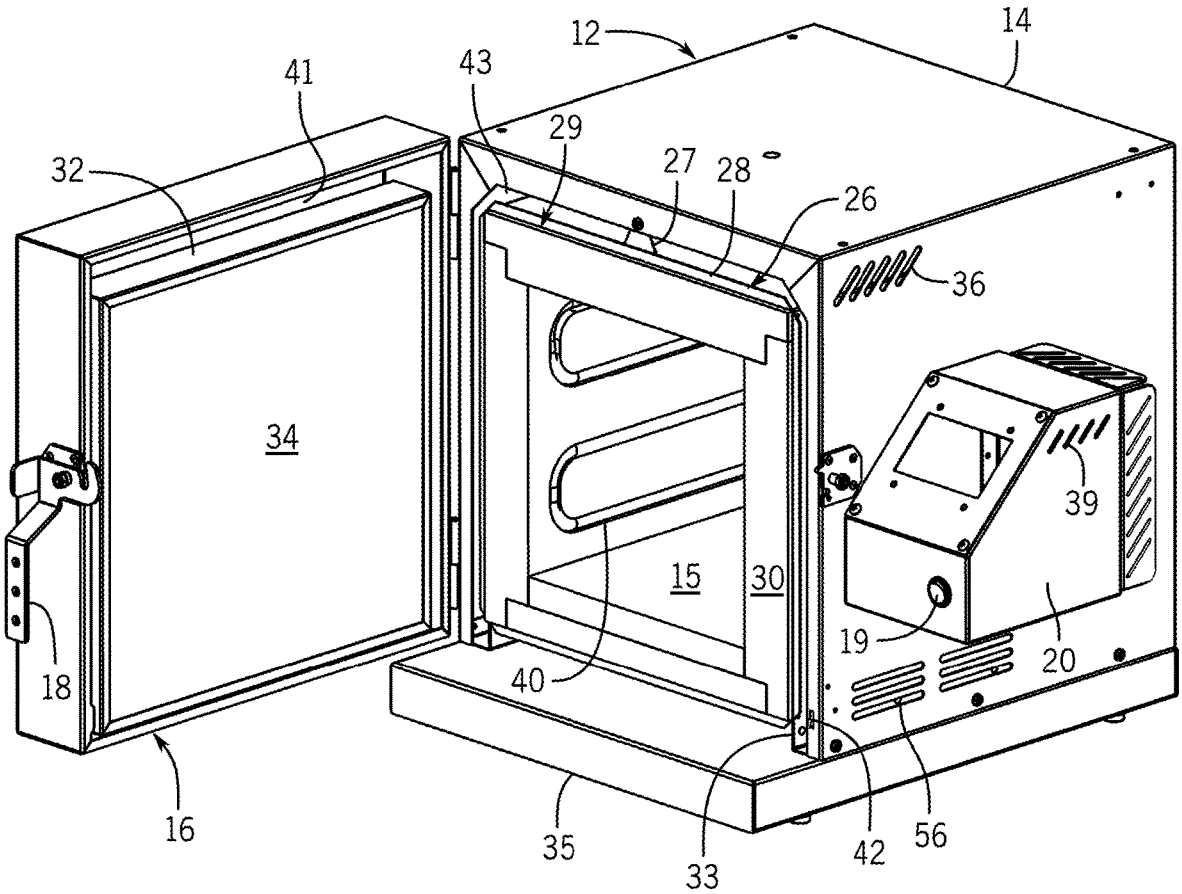
FIG. 2 is a front perspective view of the oven of FIG. 1 with a door open.
Figure 3:
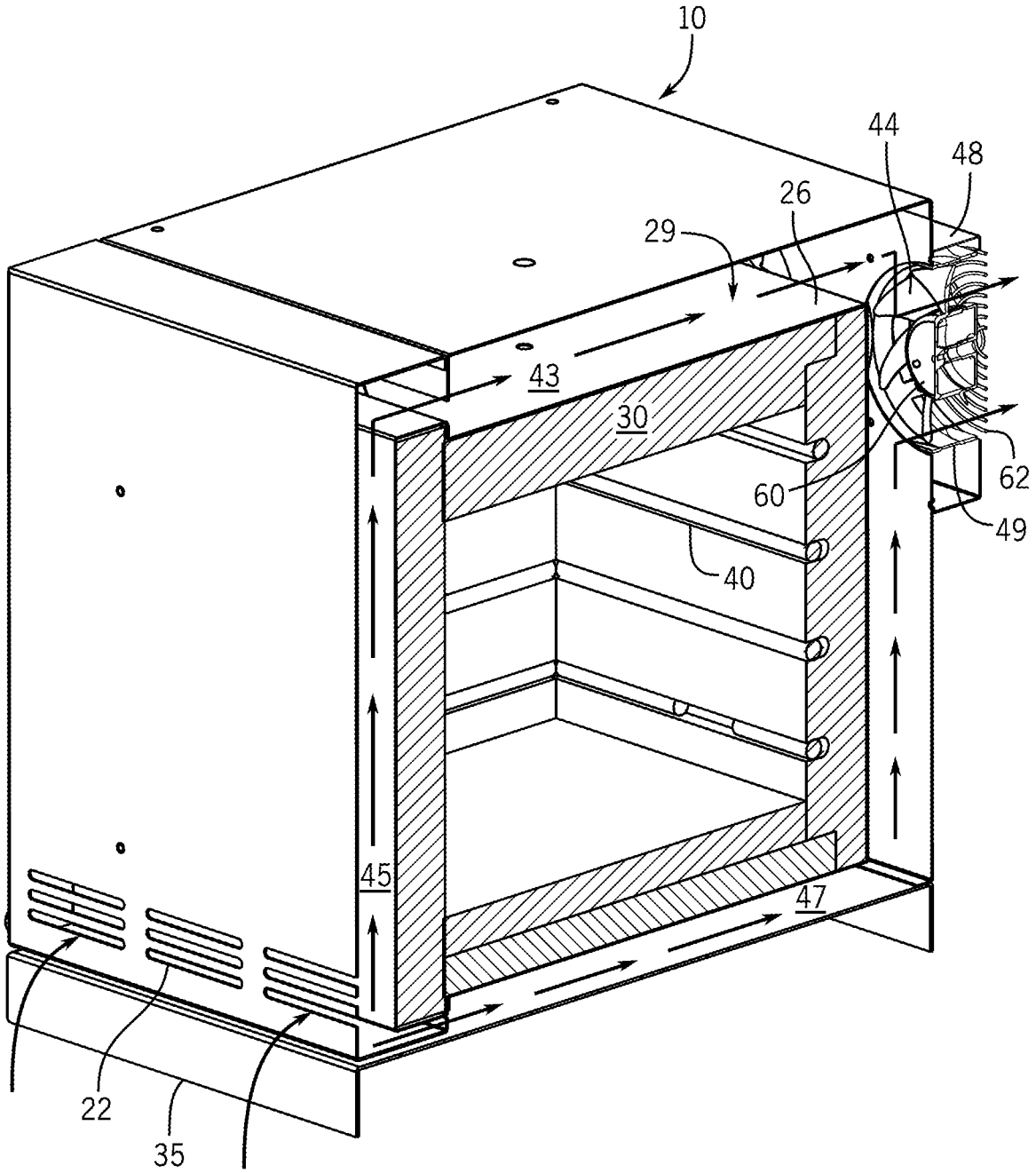
FIG. 3 is a perspective cutaway side view of the oven of FIG. 1, illustrating fluid flow through the plenum.

Referring now to FIGS. 1 and 2, a kiln or oven 10 constructed in accordance with the present disclosure is shown. The heat treating oven 10 can include an oven core 26 with insulation 30, and an outer shell or housing 12, the outer shell including a housing body 14 which, as illustrated, can include four side panels or walls coupled to and extending perpendicular to the edges of a back panel to define an opening 15, and a corresponding door 16 that encloses the opening 15 in the housing body 14. The door 16 can be latched to the housing body with a latch 18. Referring now also to FIG. 3, exhaust fans 44 or 45 or a blower is provided at a rear of the outer shell 12, and forces air through a plenum 43 formed between the oven core 26 and the outer shell 12, as described below. Although two fans 44 and 45 are illustrated and described herein, the blower system may include a single fan, and in some cases be described below as fan 44 for simplicity.

Referring again to FIG. 2 and also to FIG. 3, the oven core 26 can include four side panels or walls extending perpendicular to the edges of a back panel wall, similar to the construction of the outer housing 14, and is sized and dimensioned to be received within the housing body 14. The oven core 26 includes a flange 28 that protrudes perpendicular to an outer edge of the side walls of the core 26, toward the perimeter of the housing body 14 when mounted in the housing body 14. The flange 28 enables an insulating layer 30 and heat coil 40 to be assembled before insertion, as described more fully below. The walls or panels may include vents to allow some fumes/particulate to escape from the core in operation. These vents can be, for example, about ⅛ inch diameter holes.

Figure 9:
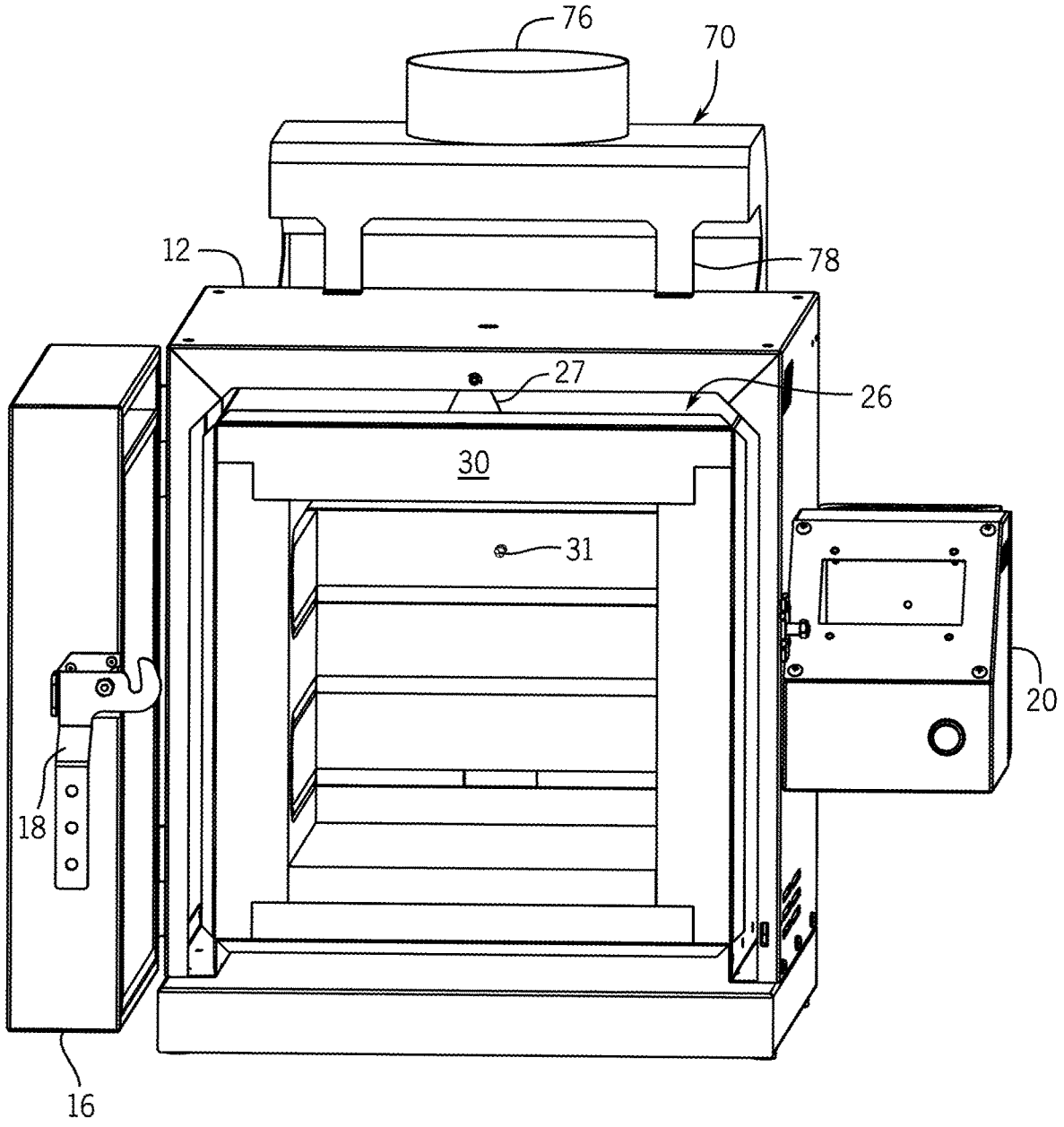
FIG. 9 is a front view of the oven of FIG. 1 with the door open and a hood attached.

The vertical side panels or walls extend past the bottom horizontal side panel or wall, and form a flange 33 which can be mounted to a base 35 of the oven 10, mounting the core 26 above the base 35 of the housing 12 without disrupting airflow. Tabs 27 protruding from the stainless oven core 26 can be attached to an inward flange of the outer oven shell 12. The tabs 27 provide stiffness in the plane parallel to the opening 15 of the oven 10 which is covered by the door 16. When the door 16 is closed, the door 16 also provides stiffness in this plane. The insulating layer 30 includes four side walls or panels extending perpendicular to a back wall or panel, and is sized and dimensioned to be received within the oven core 26 to form an oven core assembly 29. The insulating layer 30 protrudes outward from the outer edge of the oven core 26 toward the door 16. The protruding insulating layer 30 can be used to create a non-metallic, high temperature seal with the door 16, as described below. The oven core 26 can be constructed of stainless steel, and the insulating layer can be a ceramic material, or other materials, also as described below. Referring now again to FIG. 3, the oven core 26 includes a heating coil 40, that is connected to a controller 20. A thermocouple 31 inside oven core 26 (FIG. 9) can be monitored by controller 20.

The door 16 can comprise a vertical panel or wall and four side panels or walls extending perpendicular to the vertical panel, and defining an opening. The door 16 can also include a frame 32 which is mounted to the vertical panel of the door 16 within the opening. The frame 32 can be sized to correspond to the outer perimeter defined by the side panels of the oven core 26, and receives insulation 34 which, when the door 16 is closed, abuts against the insulating layer 30 in oven core 26 to create a non-metallic seal, enclosing and insulating the oven core 26.

Figure 4:
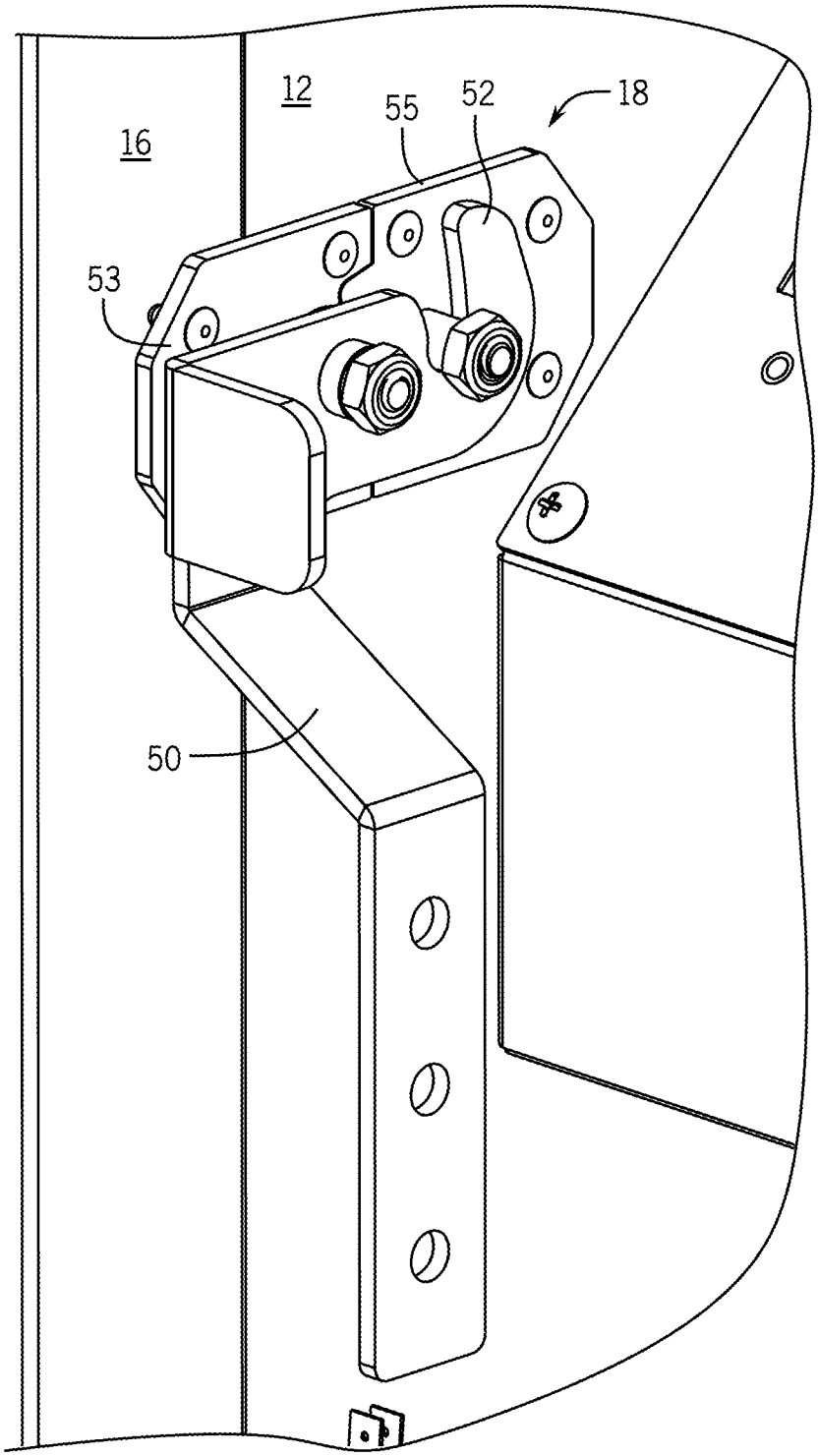
FIG. 4 is a detailed view of a latch of the door of the oven of FIG. 1, taken along the line 4-4 of FIG. 1.

Referring now to FIG. 4, the latch 18 includes a cam style latching mechanism 52 that also has plates 53, 55 with alignment pins to keep the door 16 aligned when the door closes. This helps to keep the door insulation 34, which is also the door seal, from wearing in different spots, expanding the door seal and reducing its effectiveness. The handle 50 is offset from the interface between the door 16 and the housing body 14 (the door opening), so that hot air or gases do not come into contact with the operator's hand or arm when opening a hot oven. The handle 50 rotates away from the door 16 opening even further when the latching mechanism opens. A limit switch 42 can be provided in the housing body 14 directly to the housing body 14. The limit switch 42 can be actuated by door 16 to provide a signal to indicate that the door 16 is closed, and can open the circuit to the heat element(s) in case the door 16 is opened.

Figure 5:
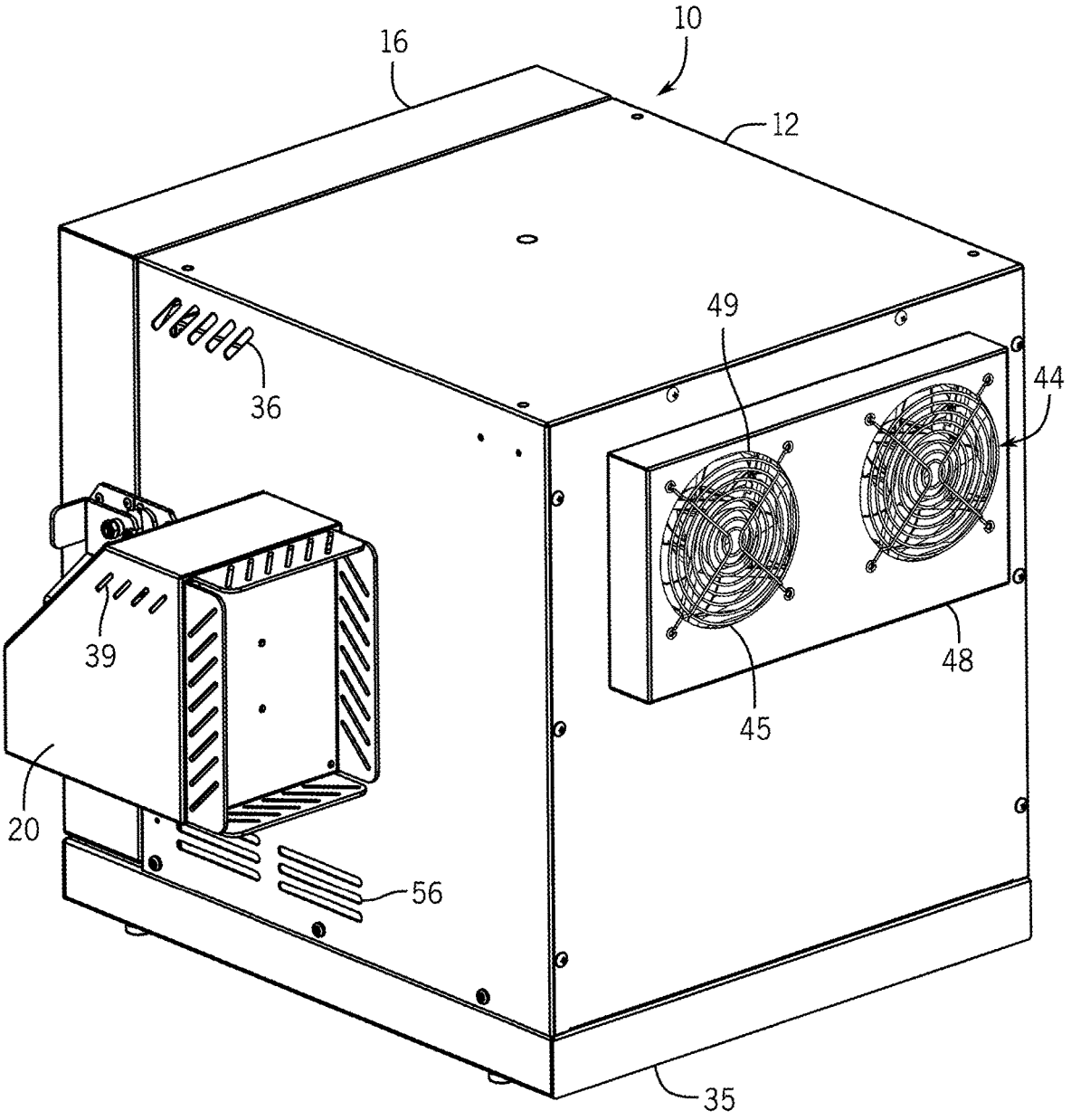
FIG. 5 is a rear perspective view of the oven of FIG. 1.

Referring again to FIG. 3, the outer perimeter of the oven core 26 is smaller than the interior perimeter of the housing body 14, thereby providing an airspace or plenum 43 (see also FIG. 2) between the housing 14 and the oven core 26 which can trap and evacuate heat, smoke, and fumes generated by the heating coil 40 in the oven via one or more fan or blower system 44, 45 (FIG. 5). The exterior perimeter of the frame 32 and corresponding insulation 34 mounted to the door 16 is similarly smaller than the interior perimeter of the door 16, and therefore provides a plenum 41 that is continuous with plenum or airspace 43 so that the hot air around the door 16 is also evacuated by the blower system 44.

Referring again to FIG. 3 and also to FIG. 5, a fan vent 62 sized and dimensioned to correspond to the exhaust fan 44 is provided in an upper portion of the rear vertical panel of the body housing 14. The fan vent 62 can be a screen or include a plurality of sectors cut into the body housing 14, surrounding a solid circular radiant deflector 60. The outer diameter of the sectors can be sized to correspond to the size of the fan blades, and the radiant deflector 60 can correspond to the center hub and motor of the fan. The exhaust fan 44 can be provided in a fan housing 48 which is mounted to the upper portion of the rear panel of the housing body 14 adjacent the fan vent 62. The side of the fan housing 48 that faces the body housing 14 is open, enabling the fan 44 to extract air from the oven 10, and an aperture 49 is provided in the rear of the fan housing 48, so that air can exhaust from the rear of the oven 10. The watts/cfm exhausted minimizes the air temperature around the fan 44, minimizes the increase in temperature of the fan, and also minimizes wear on the fan 44. The fan is loaded so the CFM will be reduced. This reduced CFM is taken into account when sizing an appropriate fan for a given size of oven. A similar fan vent is provided for fan 45, as illustrated.

Referring again to FIG. 1, main airflow vents 22 are positioned in a lower portion of the door 16, and therefore in a position in the housing 14 opposite to the exhaust fans 44 and 45 which are at the upper portion of the rear of the housing body 14. The position of the vents 22 opposite the fans 44 and 45 ensures the airflow from the fans 44 and 45 is split around every surface of the oven.

Figure 11:
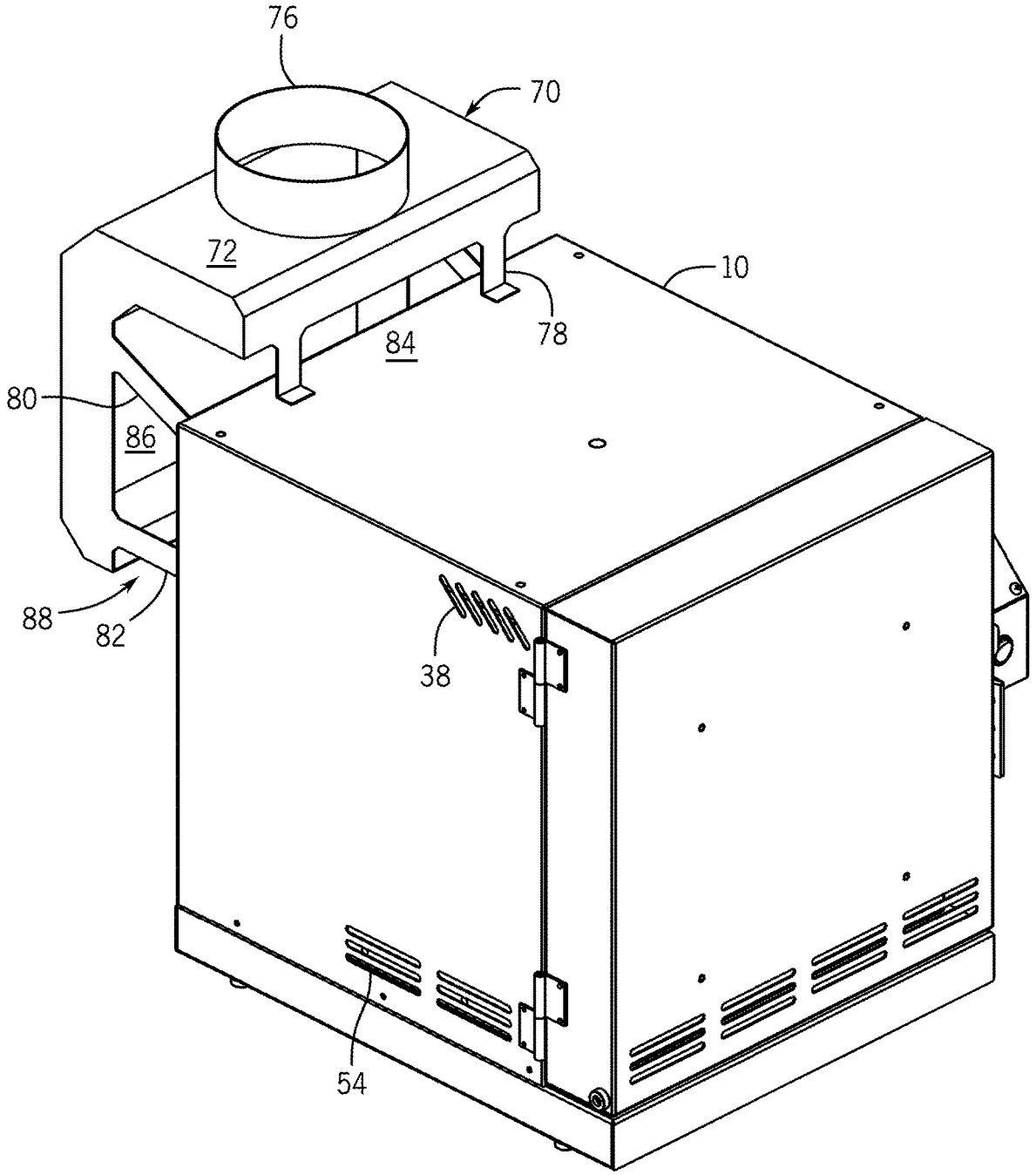
FIG. 11 is a front perspective view of the oven of FIG. 1 with the hood of FIG. 9.
Figure 16:
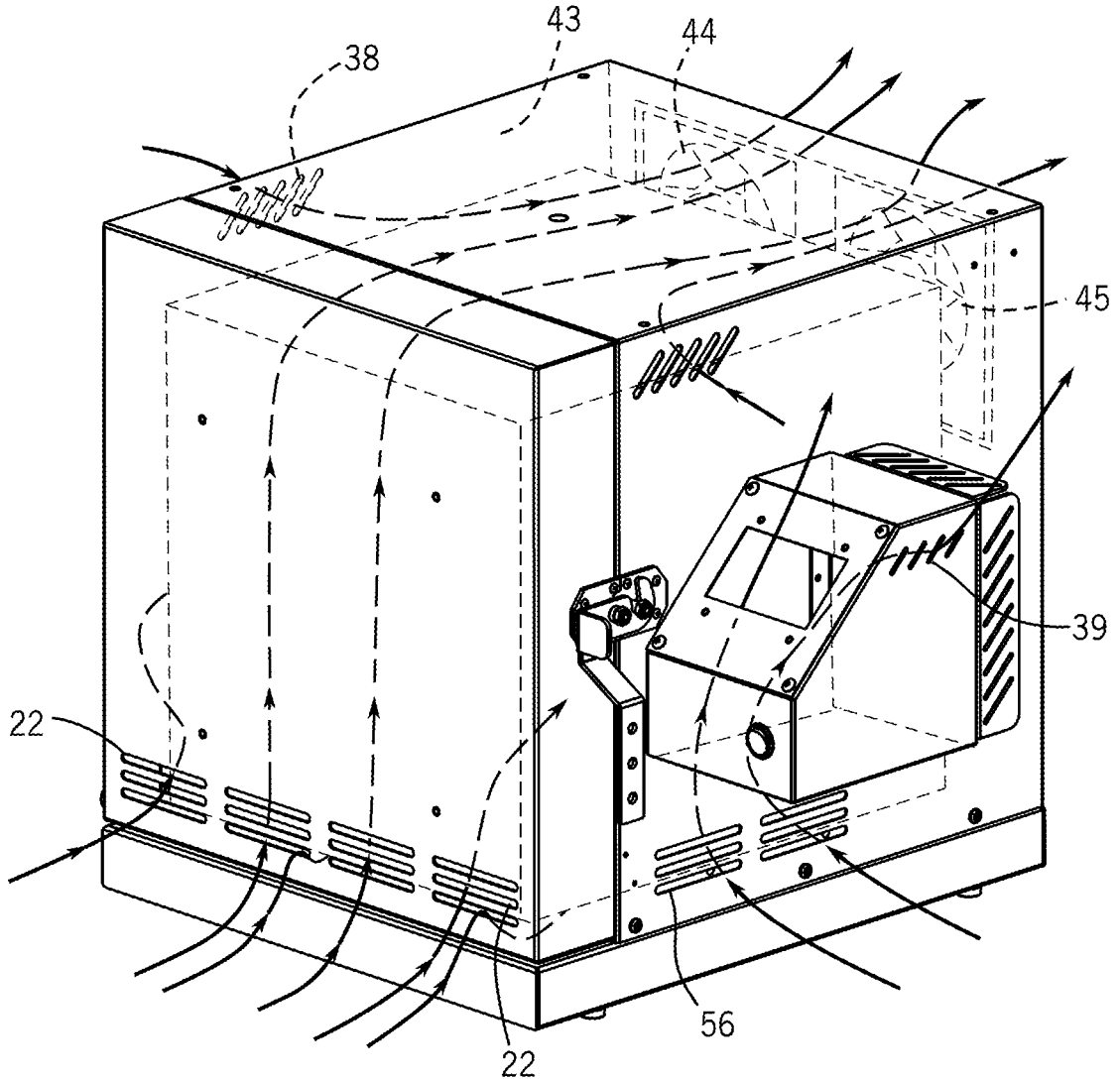
FIG. 16 is a front perspective view of the oven of FIG. 1 illustrating fluid flow through the system.

Referring now also to FIGS. 1, 11, and 16, additional vents 36, 38, 54, and 56 are positioned to fine tune the airflow and even out the heat distribution on the outer surface of the oven 10. These vents 36, 38 include vents that are placed in the side walls or panels of the housing body 14 of the outer shell 12, adjacent a top of the housing 14 to help evacuate hot air in the case of a fan failure, and only convection air movement is present. Vents 39 can also be provided in the housing of controller 20.

Figure 6:
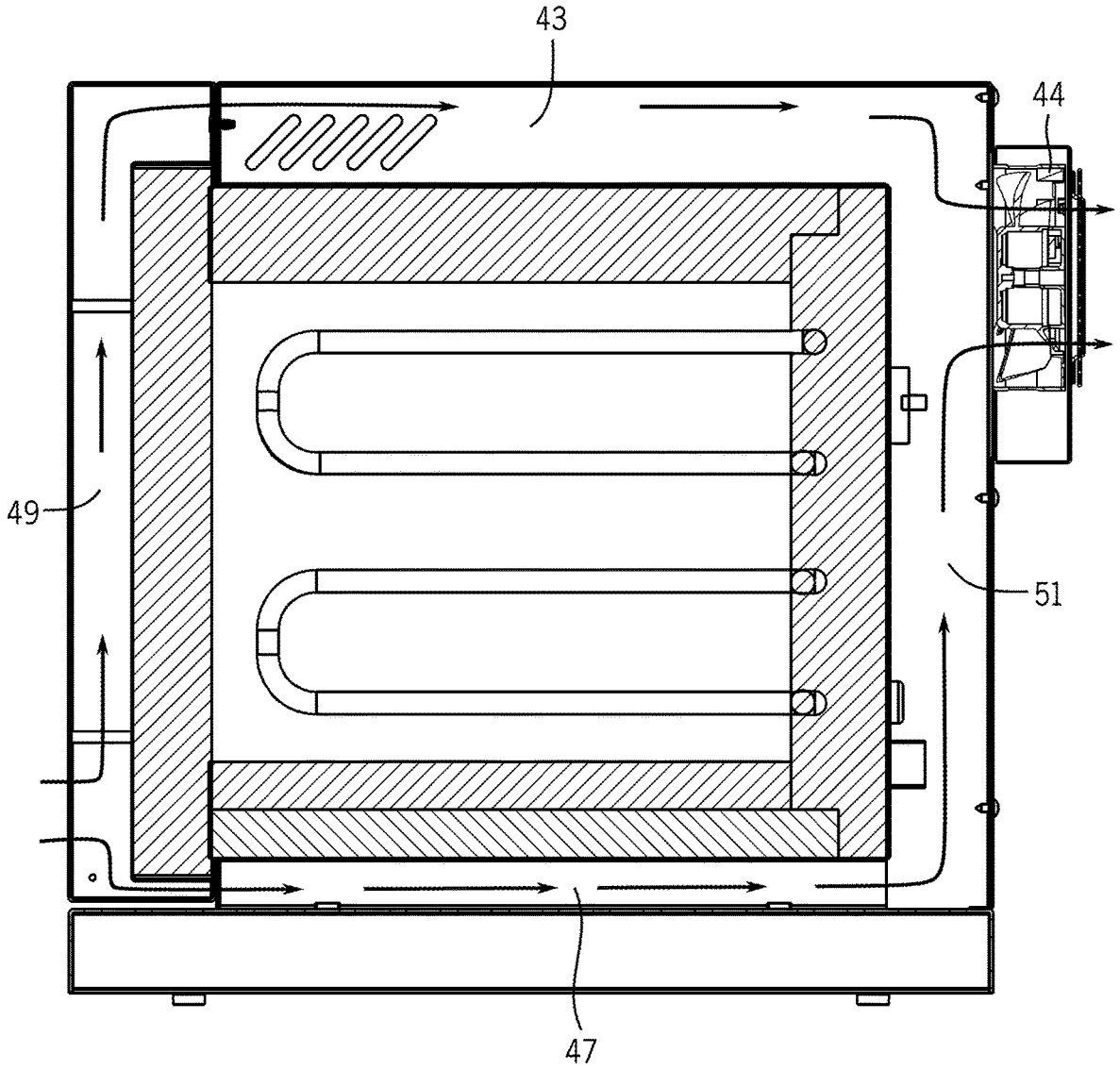
FIG. 6 is a cutaway side view of the oven of FIG. 1, illustrating fluid flow.

Referring again to FIG. 3 and also to FIGS. 6 and 16, the air flow through the oven 10 is illustrated in a sectional and cutaway view. As illustrated here, ambient air is forced through the main airflow vents 22 by the low pressure developed by the fan or blower 44, 45. The air is circulated toward the exhaust fans 44, 45 along a plenum 43 formed across the top of the oven 10, between the sides of the oven core 26 and the outer shell 12, a path along plenum 49 formed between the housing body 14 and oven core 26, a path along a plenum 47 between the bottom of the oven core 26 and bottom of the outer shell 12 or base, and a plenum 51 at the rear of the housing 14.

The insulation and air flow system described above is designed to keep the outside surface of the outer shell 12 no more than approximately a 20 degrees C. rise over the ambient temperature. This temperature rise is maintained by following the process and formulas below.

The temperature rise is inversely proportional to the air flow. The air flow is often measured in cubic feet per minute (cfm). The airflow needed to maintain a 20 degree C. rise over ambient temperature is directly proportional to the output power of the oven 10, often measured in watts, which can be estimated by the watts of the oven heating coil times the duty cycle of the oven at the time the measurement is taken, as set forth in the following formula:

$$\text{degrees } C_{rise} = (1.8 \times \text{watts})/cfm.$$

For example, when the oven is at max temp, 1093 C, its duty cycle is about 50%, which means that the heating coil is energized 50% of the time. If the heating element is drawing 17 amps at 120v, that is 2040 watts. Fifty percent of the 2040 watts is 1020 watts, which is the wattage produced by the heating coil.

Applying the 1020 watts into the formula above, (1.8×1020)/100 results in a rise of about 18 degrees Celsius. Assuming an ambient temp is 20 degrees C., the system removes enough heat for the outer temperature to be maintained at about 38 degrees C.

Because of convection, proportionally more airflow is provided in the upper plenum 43 than the lower plenum 47. This is achieved by reducing the flow to the lower plenum 47 relative to the air flow in the side plenums 49 and upper plenum 43.

Referring again to FIGS. 5 and 6, the exhaust fans 44, 45 evacuate air created at a lower pressure around the oven core 26. Lower pressure air is a better insulator and reduces the amount of heat transfer through the plenum air, from the oven core 26 to the outer surface of the oven 12. The lower pressure created in the plenum 43 from exhausting the air also allows some air to be vented through vent 39 in the housing for controller 20 to help keep the electronics cool.

The exit of the fan enclosure 48 can be attached to a vent tube so that the air can be routed from the housing 14. For example, air can be routed outside of a room or building where the oven 10 is used.

The oven 10 as described above is also designed to provide a simplified and efficient assembly process. The insulating layer 30 and heat element 40 can be assembled before it is inserted into the oven core 26. The oven core 26, the coil 40 and a thermocouple can be assembled before the outer enclosure 12 is attached. The oven core 26 and outer shell 12 are designed to simplify this assembly. Electrical connections are provided in the rear of the housing body, which can facilitate easy wiring of the heat coil. The ends of the heat coil can be extended directly out the rear of the housing body as the ceramic insulation is inserted into the stainless oven core.

Figure 7:
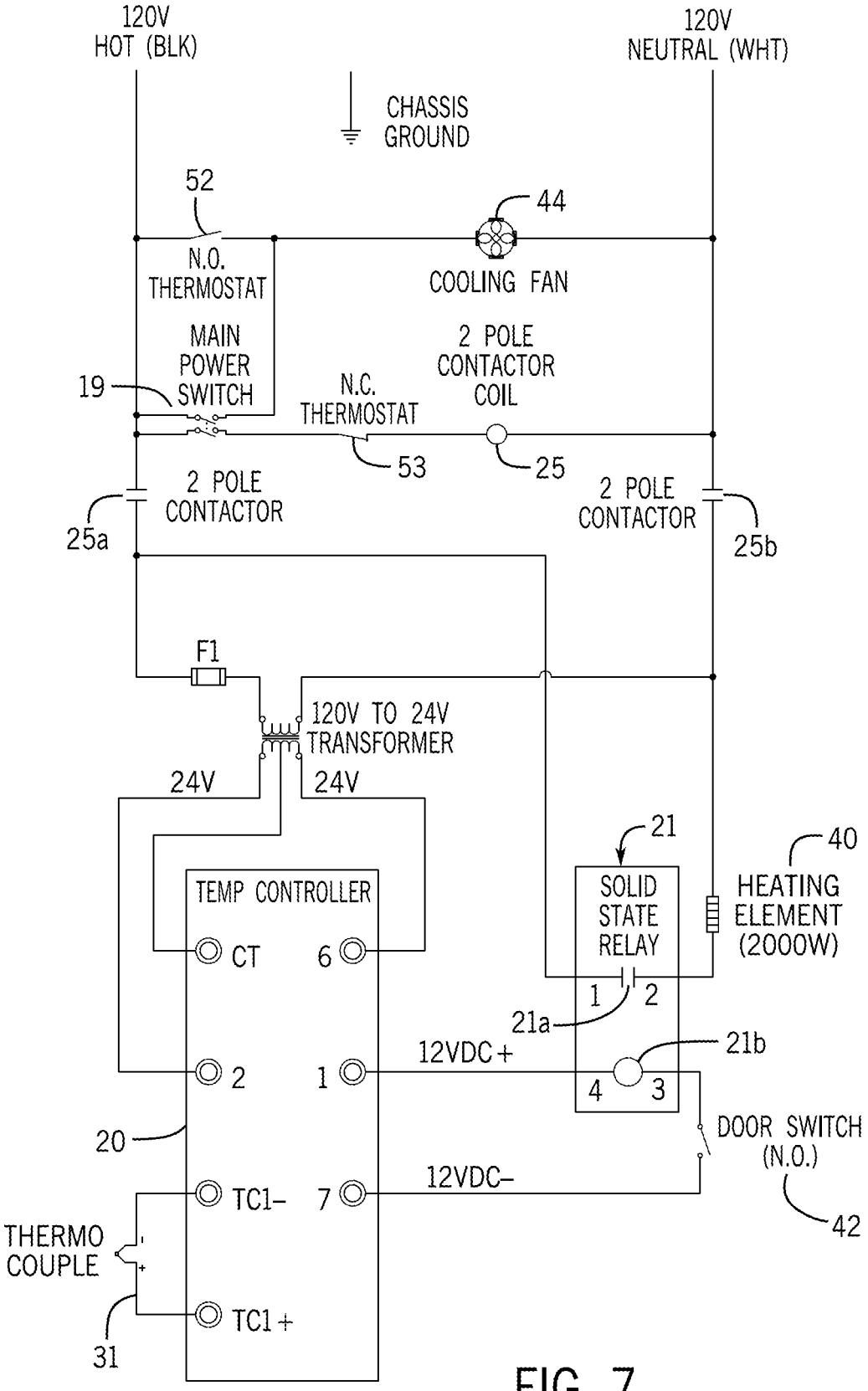
FIG. 7 is a schematic of a control system that can be used with the oven of FIG. 1.

Referring now to FIG. 7, an exemplary control system for controlling oven heat is illustrated. As illustrated here, when a power switch 19 is activated, 120 VAC is applied to fan 44 and to 2-pole contactor coil 25, closing normally open contacts 25*a* and 25*b*. Power can be applied to heating element 40 when limit switch 42 indicates that door 16 is closed, allowing controller 20 to selectively provide 12 VDC to activate solid state relay 21, closing normally open contacts 21*a*, thereby providing 120 VAC to the heating element 40. Controller 20 monitors the temperature of the oven 10 by monitoring thermocouple 31, and can activate and deactivate solid state relay 21 to adjust the temperature. When a predetermined temperature of the housing is reached, the normally closed thermostat contact 53 is opened, removing the 120 VAC from the contactor coil 25 and opening contacts 25*a* and 25*b*, thereby removing 120 VAC from the rest of the circuit, including heating element 40. To continue cooling of the oven 10 after deactivation, the normally open thermostat contact 52 is closed when the core 26 is above a selected temperature, maintaining 120 VAC across the fan 44 even if the main power switch 19 is deactivated. The oven 10 therefore can be actively cooled until it reaches a selected temperature, even if the power is turned off. In one example, the normally closed thermostat contact 53 was mounted to the housing 14 and selected to open when the housing 14 reaches 160 degrees F. The normally open contact thermostat 52 was mounted to the core 26 and was selected to close when the core 26 reaches 120 degrees F., and to open again when the temperature falls to 105 degrees F.

In some embodiments, the fan or blower 44 can alternatively be controlled by a timer, independent from the controller 20, that keeps the fan/blower 44 running for a predetermined time after the oven is turned off via its power switch 19. This ensures proper cooling of the oven 10. Only removal of power completely from the oven 10 will then allow the temperature of the outer shell of housing 14 to exceed designed limit. The timer can be set to turn the fan/blower 44 on after a predetermined time with power applied to the heating element 40. This keeps the fan/blower 44 from running while only programming the controller 20 is being performed.

Figure 8:
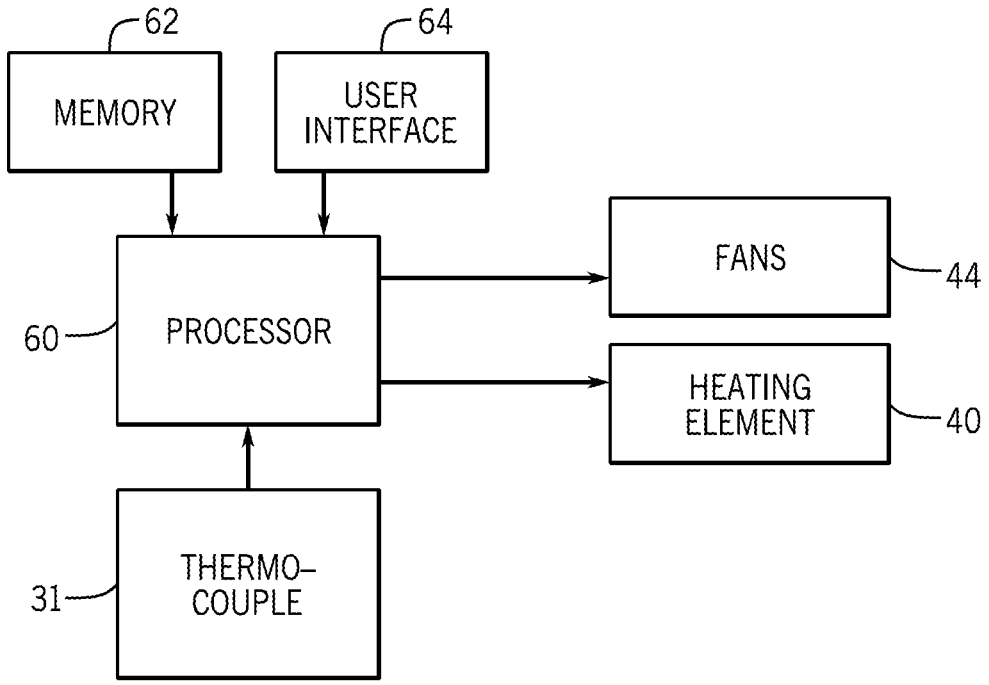
FIG. 8 is a block diagram of a control system that can be used with the oven of FIG. 1.

In alternate embodiments, a controller can be used to provide active control of the heating and/or cooling elements in the oven 10. Referring now to FIG. 8, a block diagram of a controller that includes a processor 60, memory components 62, and a user interface 64 is illustrated. The processor 60 receives input from thermocouple 31 and, based on temperature data stored in memory 62 or entered through user interface 64, the processor 60 drives the heating element 40 and/or the fans or blower system 44 and 45 to heat and/or cool the system. For example, the processor can store executable programs providing active cooling instead of the convection cooling described above. Active cooling can be used to reduce the thermal time constant of the oven 10, which is also influenced by the mass of the material or part being heated. This reduced thermal time constant allows, for example, a proportional Integral Derivative (PID) algorithm to enable processor 60 to accurately control temperature.

Alternatively, processor 60 can employ control loops to control heating. Control loops, such as a PID can be used to calculate an error signal as the difference between temperature set through user interface 64 or stored in memory 62, and a temperature measured by thermocouple 31, This error signal can be input to a PID algorithm in the controller 60, which compares the actual temperature and the desired temperature to determine an error signal. When the error signal is negative, the temperature set point is less than measured temperature, and the PID algorithm drives the heating element or elements 40 to produce additional heat. The error signal in an actively cooled oven as described here can approach the defined temperature more accurately than in some methods because of the reduced thermal time constant, hence increasing the PID output signal (duty cycle applied to the heating element) and therefore improving the accuracy and consistency of the control of the oven. This increased control can be applied to both heating and cooling.

In one embodiment of an oven of the type described above, a Novus 480D programmable controller was used to control the heating coil. A failsafe overtemp manual reset thermostat was used to enable a user to reset the heating. As described above, the controller can be connected to a solid state relay, which in this embodiment, was selected to be a 40 amp rated solid state relay (SSR), and which was cooled with a convention heat sink. A "K" type thermocouple was connected between the heating coil and the SSR. The door was provided with a limit switch.

In some applications, the exit of the fan enclosure 48 can be attached to a vent tube so that the air can be routed from the housing 14. For example, air can be routed outside of a room or building where the oven 10 is used. In some applications, the integrated cooling fan/blower system 44 described herein can draw out fumes and particulate in the air from inside the oven core. This exhaust/cooling air can be ducted from the vents at the back of the oven 10 directly to the outside using the cooling fan/blower system 44 if cfm can be maintained or, alternatively, through a separate fan/blower or filter/exhaust system. A filter/exhaust system can also be integrated into the oven using its own fan/blower system typically with more power to handle the backpressure of a duct and the backpressure of a filter.

Figure 10:
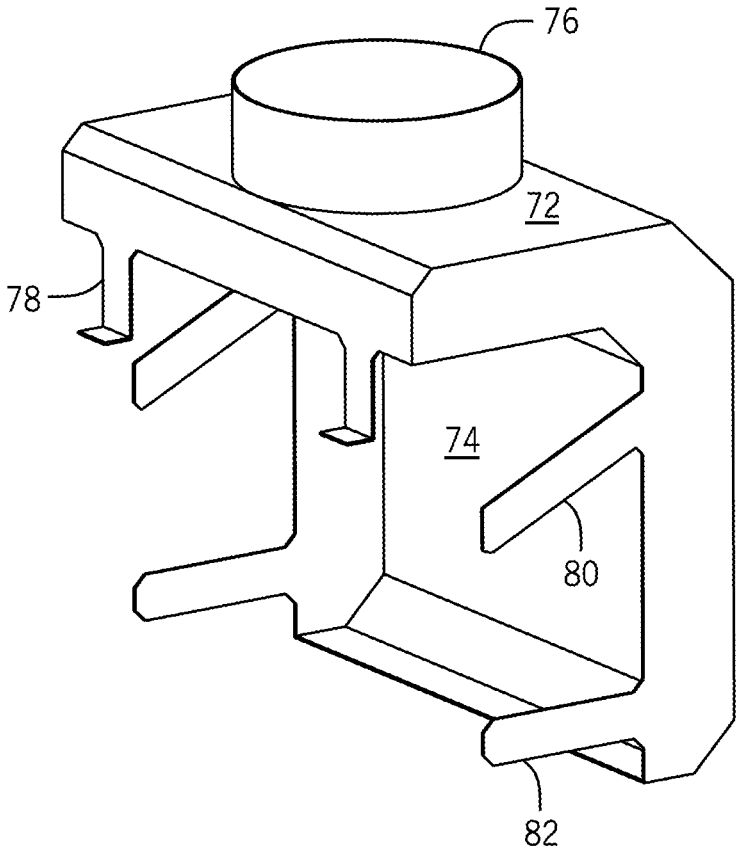
FIG. 10 is a perspective view of the hood of FIG. 9.
Figure 12:
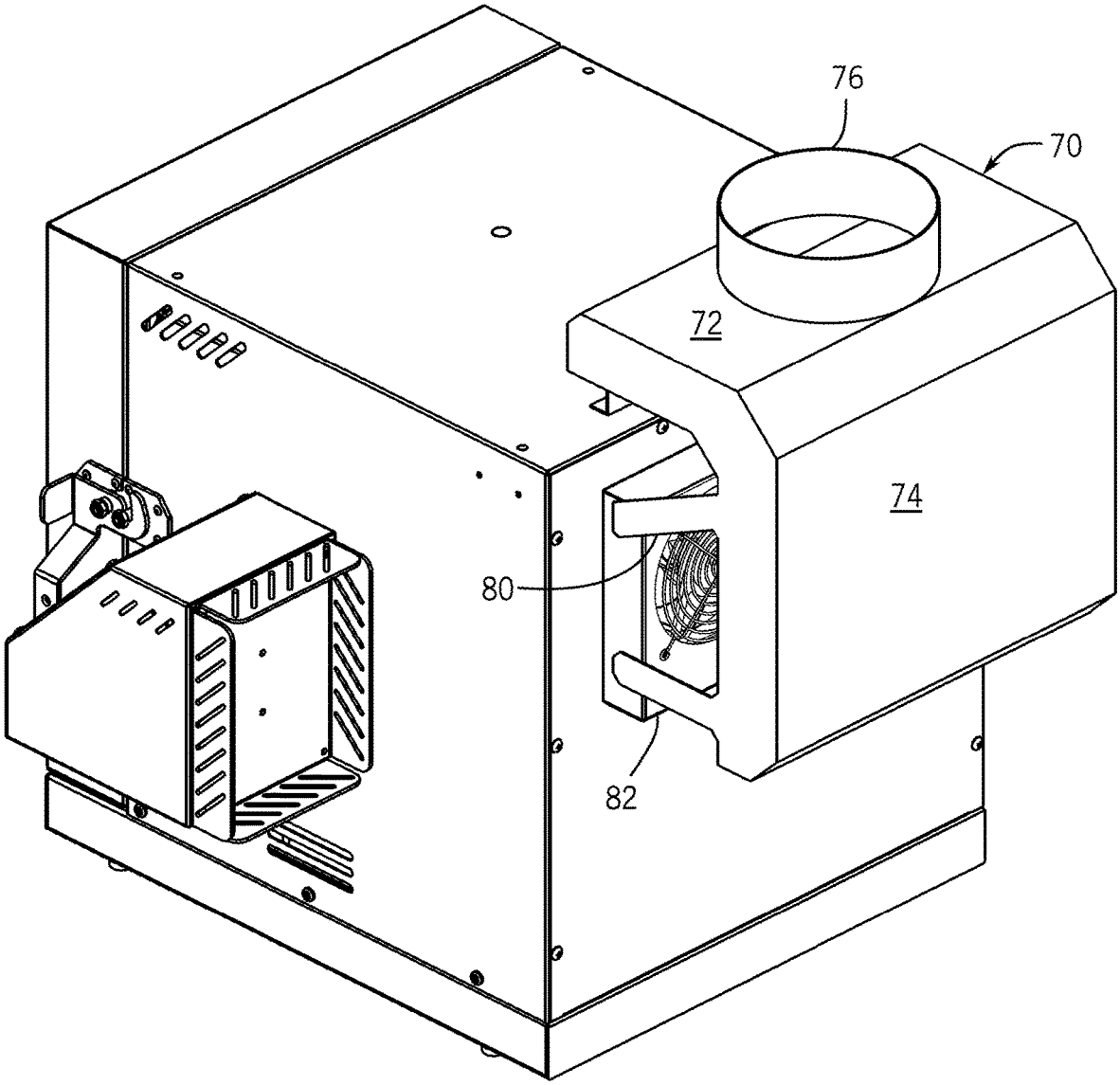
FIG. 12 is a rear perspective view of the oven of FIG. 1 with the hood of FIG. 9.
Figure 13:
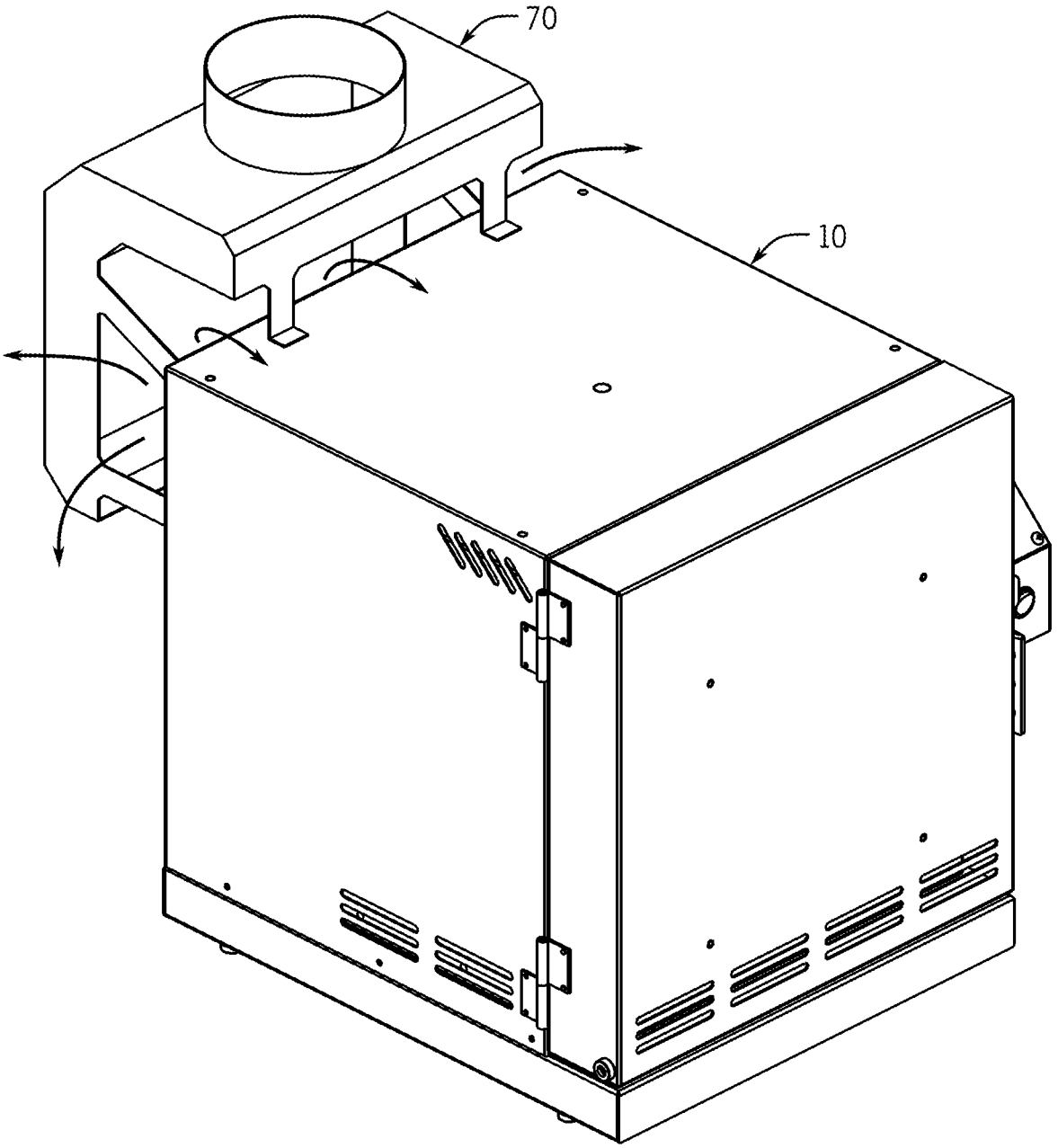
FIG. 13 is a front perspective view of the oven of FIG. 1 with the hood of FIG. 9, illustrating air flow when the oven fan is on and an externally connected blower is off or blocked.
Figure 14:
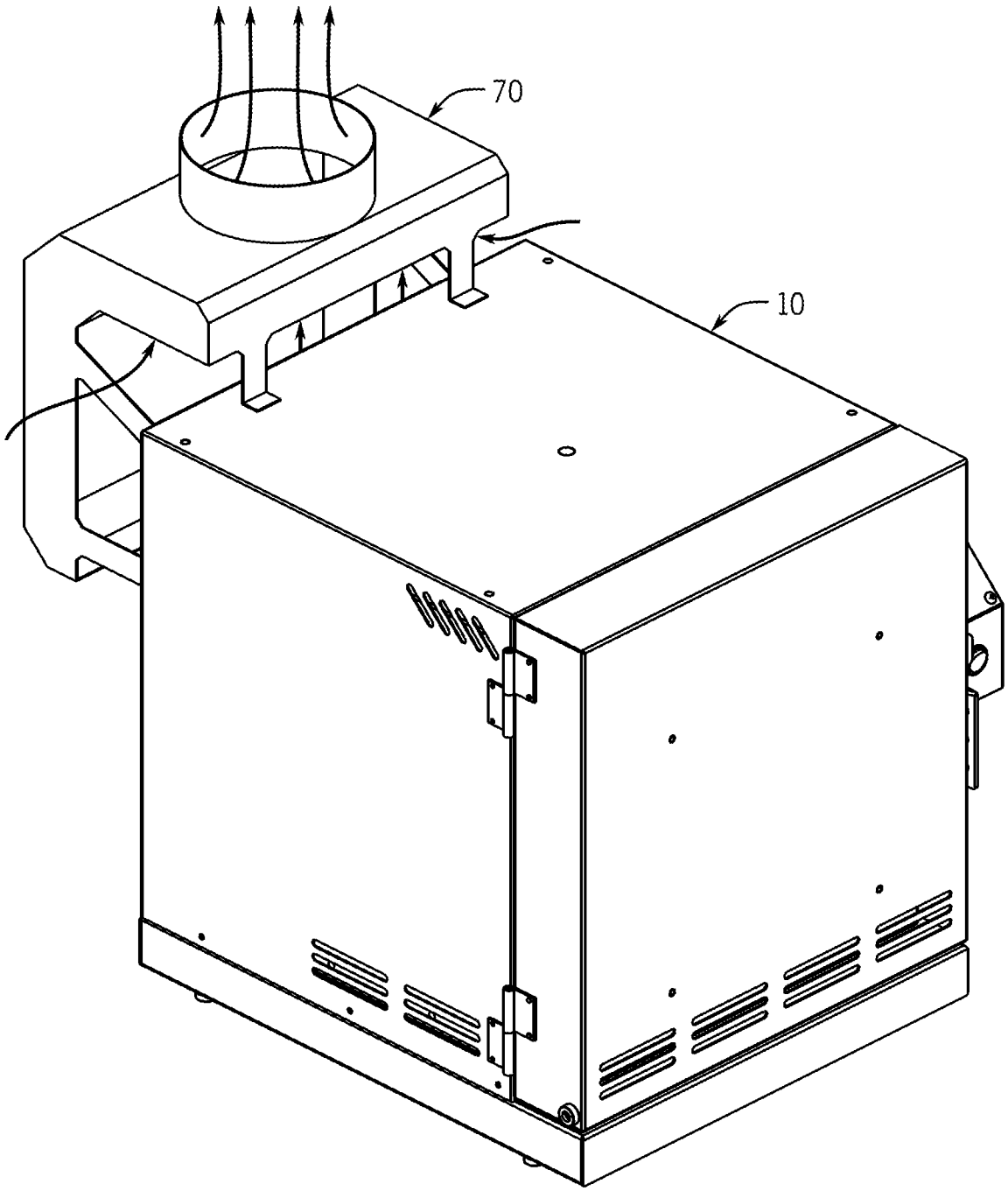
FIG. 14 is a front perspective view of the oven of FIG. 1 with the hood of FIG. 9, illustrating air flow when the oven fan is on, and an externally connected blower is on and capturing oven fan air.
Figure 15:
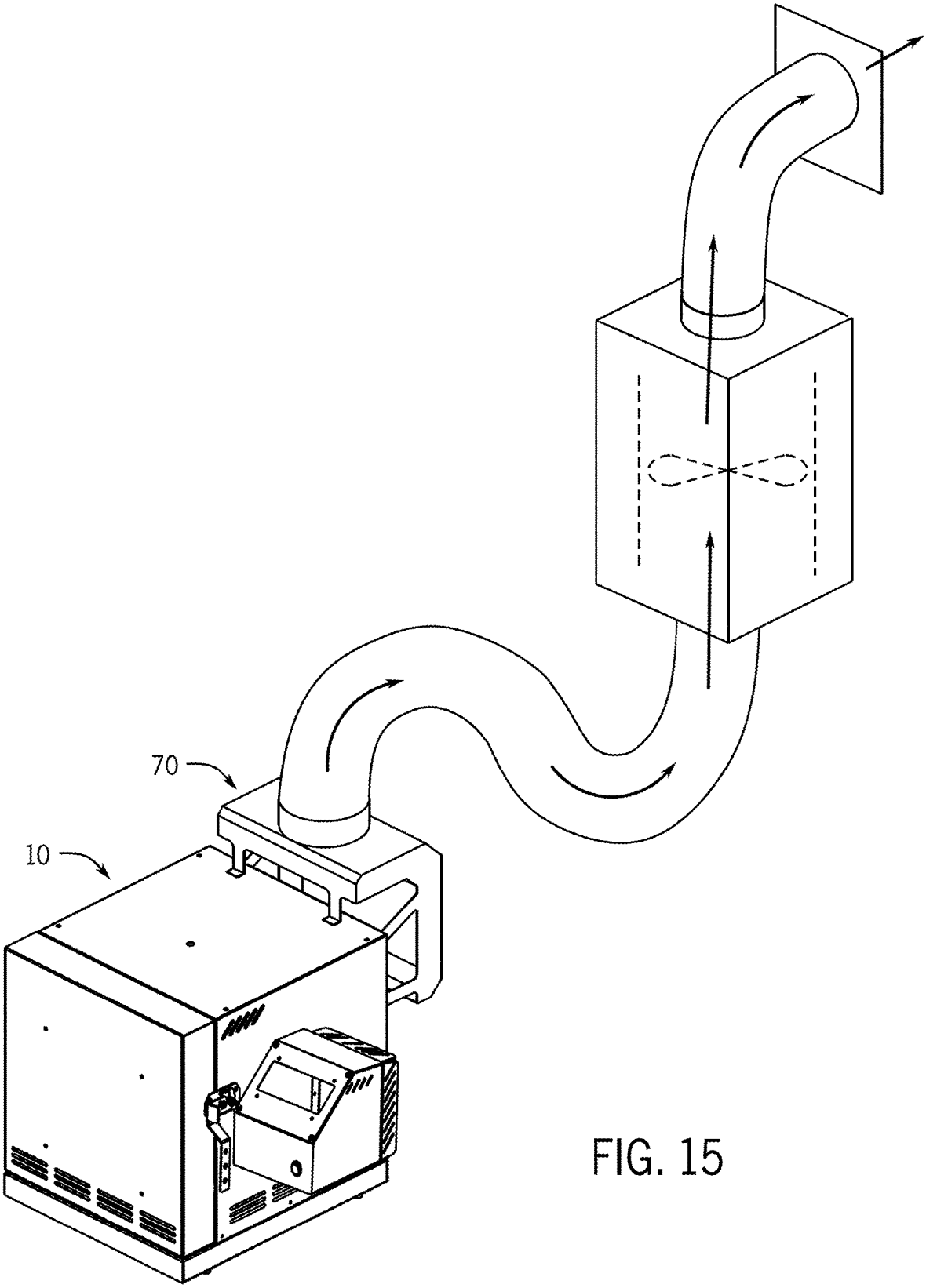
FIG. 15 is a front perspective view of the oven of FIG. 1 with the hood of FIG. 9, illustrating connection to an external blower.

Referring now to FIGS. 9-15, in alternate embodiments, a localized duct hood 70 can be positioned adjacent vents 62 of the cooling system 44 to draw out the oven exhaust/cooling air when fan/blower system 44 is running. Referring now to FIG. 10, the duct hood 70 can include a horizontal flange 72 including an air vent opening 76 extending above the horizontal flange 72, and a vertical flange 74 extending from a back edge of the horizontal flange 72. Mounting feet 78 extend from the horizontal flange, and can be mounted to the housing body 74. Mounting arms 80 and 82 extend inward from the vertical flange 74 in the same direction as the horizontal flange, and can be mounted to the fan housing 48, as seen in FIGS. 11 and 12. As illustrated, when the duct hood 70 is mounted to the oven 10, the horizontal flange 72 is offset a distance above the top of the oven 10, which is defined by the mounting feet 78. The vertical flange 74 is offset a distance from the back panel of the oven defined by a length of the horizontal flange 72 and the mounting arms 80 and 82. An upper air vent space 84 is defined between the top of the oven 10 and the horizontal flange 72, a side air vent space 86 defined between the back of the oven 10 and the vertical flange 74, and a bottom air vent space 88 defined by the bottom edge of the vertical flange 74. Referring now to FIG. 15, an external blower or filter can be connected to the air vent opening 76 for expelling air. When the external blower or filter is in operation, air is directed through the air vent opening 76 in the duct hood 70 (FIG. 13). When the hood blower is turned off or clogged, air is instead directed through the air vent space 84 formed between the housing body 14 of the oven 10 and the horizontal flange 72 of the duct hood, and through the air vent space 86 at the sides of the duct hood 70 (FIG. 14). The hood 70, therefore, allows the oven exhaust/cooling air to cool the oven 10, even if the exhaust/filter system becomes disabled due to a blockage, power outage, dirty filter, or other failure, and the oven will still be able to cool and continue its operation.

Example 1: Although many types of components can be used, in one embodiment, an oven 10 was constructed with a dual layer air plenum, and the oven core 26 was constructed of 20 gauge 304 stainless steel. The outer shell or housing was powder coated 18 gauge steel. The insulation was ceramic, with the door 16 insulated with two-inch Kaowool insulation. A 16 gauge Kanthal A-1 2000-watt, 17 amp total oven load heating coil was used. The supply circuit was rated at 120V, 20-amp. The working chamber was 360 cubic inches, and a maximum operating temperature of 2000F or 1093C max was maintained. The operating temperature of 2000F/1093C was achieved from in ambient state in under 30 minutes, while maintaining a temperature rise on the outer surfaces below 20 degrees Celsius. The air gap forming the plenum was 1.25 inches on the sides, 2 inches between the top surfaces, and 1 inch at the bottom. The top gap was made larger to accommodate the fan, air vents, and to maintain additional space for additional elements such as top mounted thermal couples. The rear gap can be 2 inches or larger to provide space for electrical connections.

In addition to the materials described above, ceramic fiber board, fire brick, fiberglass, wool, and similar insulation materials can be used, as well as any refractory high temp material. The inner core 26 of the oven 10 can be constructed of any material that can withstand the heat and meet structural requirements to keep the insulation 30 intact. Suitable materials include 304, 316, and 410 stainless, galvanized or galvannealed steel, low carbon steel, or aluminum, for example. The core 26 can be optimally produced using 24 through 14 gauge material. In some applications, non-metal materials such as ceramics can also be used. The housing 14 can be constructed of stainless steel, which can be painted, powder coated, or uncoated. Alternatively painted steel or other materials, including aluminum can be used. The housing 14 can be produced using 24 through 14 gauge material, depending on environmental conditions.

Fans or blowing elements are selected based on the amount of air flow required in the plenum to maintain outer housing 14 of the oven 10 to a selected minimal temperature rise. For small ovens, small fans of the type used in computers, typically in the range of 100 cfm, can be used, either alone or in an array producing 1000 cfm or more. A larger single fan or combination of larger fans can also be used. A single 120 mm computer fan has been successfully applied in ovens ranging from 1000 to 2000 watts with one fan, and an array of 8 fans has been successfully applied to a 16,000 watt oven. A single 800 cfm fan or blower, or combinations of smaller fans producing 800 cfm can also be used.

Example 2: Range of Airflow. A 2000 watt oven with ceramic fiber insulation that slows the heat loss so that only 1000 watts is needed to maintain an internal temperature of 2000 degrees F., needs about 90-100 cfm to maintain a 20 degree rise in the outer shell temperature. The wattage of the oven is larger than the wattage needed to maintain 2000 degrees to allow the oven to rise to operating temperature in under 30 minutes with material inside, which absorbs the power in the form of heat. A lower wattage heat element can be used, but the oven will heat slower. If the element is too low in power, the loss will equal the power input and the oven will not heat past a certain temperature. This outcome is very accurately approximated with the formula Degrees C. rise=1.8*watts/cfm, described above.

In order to maintain a higher temperature in the same oven, a higher duty cycle is needed, which will in turn require a higher cfm to maintain only a 20 degree rise in the outer shell temperature. If the same 90-100 cfm is used with this higher temperature, then a greater rise in the external shell temperature will be realized.

Example 3: Range of Airflow. A 4000 watt oven with ceramic fiber insulation, that slows the heat loss so that only 2000 watts is needed to maintain an internal temperature of 2000 degrees F., while maintaining the outer temperature of the housing 14 below a 20 degree C. rise in temperature can be constructed with 200 cfm of airflow. A higher duty cycle resulting in more power to the inner oven core 26 will require more cfm to maintain a selected temperature rise on the outer shell 14. Alternatively, if a higher inner core temp is desired with the same cfm, a higher temp will be realized on the outer shell.

The various aspects of the subject matter have been described with reference to the annexed drawings, wherein like reference numerals correspond to similar elements throughout the several views. It should be understood, however, that the drawings and detailed description relating thereto are not intended to limit the claimed subject matter to the particular form disclosed. Rather, the intention is to cover the modifications, equivalents, and alternatives falling within the spirit and scope of the disclosed and claimed subject matter. Although a specific embodiment has been illustrated and described above, it will be apparent that various modifications can be made to the described oven.

For example, although a hinged door is shown and described, various other types of doors including, but not limited to top hinged doors for top loading, horizontal sliding doors, guillotine style doors, and vertical drop doors can be used. The kiln body can also be hinged or suspended or moved instead of having a door.

Further, although a construction which includes four walls is described it will be apparent that the walls can be formed of a single piece, and that other shapes are contemplated. For example, a single round wall could also be used in some applications. Round, oval, and various multi-sided polygonal configurations can also be used.

Further, although fans are described for providing air flow, one or more fans, and various types of blower systems can also be used.

Also, although specific types of controllers have been described above, it will be apparent that other types of controllers can also be used in the system. For example, digital touch screen controllers can be used to control the heating coil. These types of controllers can provide a graphical user interface (GUI) that allows simple programming, program storage, visual monitoring and integration with a smartphone and computer.

Additionally, in some applications, multiple heating elements can be controlled to provide even heating of the internal oven temperatures. Additional temperature sensing elements and cooling elements can also be provided. For example, in some applications the controller can be programmed to monitor one or more internal and/or external temperature sensors. Further, although a processor is illustrated directly driving the heating element and fan in at least some of the figures above, it will be apparent that various drive systems for controlling these elements could be used.

Further, although sheet metal flanges are described above for coupling the oven core 26 to the base 35, various other methods for interconnecting the core 26 to the housing 12 while maintaining an air plenum around the core 26 can also be used. For example, stand-offs or screws or bolts providing the function of stand-offs can be provided along the bottom, top, or sides of the core 26. Cables could be used to create a structural or adjustable location for core 26, a honeycomb or similarly shaped material could be used to interconnect the core 26 and housing 14 while maintaining air flow between the components.

Although air is described above as a cooling fluid in the system, in some applications other types of cooling fluids, including argon, may be used with the oven or kiln, and the fluid may be air, argon, or a combination of air and argon. Other types of cooling fluids may also be used.

Further, although fans are illustrated, other types of fans and blowers can be used, including duct fans or duct blowers, ventilation fans or ventilation blowers, axial fans, centrifugal blowers, positive displacement blowers, squirl cage blowers, and ducted fans, by way of example.

To apprise the public of the scope of this invention, the following claims are made:

We claim:

1. An oven comprising:

an outer housing;

an oven core comprising an oven core housing, an interior insulation layer and a heating element, the oven core received within the outer housing;

a plenum between the outer housing and the oven core;

a blower inducing a cooling fluid flow through the plenum;

a door including a central insulated panel and a door plenum between the central insulated panel and an outer edge, wherein the door is moveable between an open and a closed position, and wherein the central insulated panel encloses the oven core and the door plenum mates with the plenum between the outer housing and the oven core when in the closed position, the door including a vent provided at a position opposite the blower, wherein the cooling fluid flow induced by the blower is directed through the plenum and the vent of the door;

wherein, when the door is in the closed position, the door plenum is combined with the plenum formed between the outer housing and the oven core to create a combined plenum through which the cooling fluid flows across at least a first and second peripheral region from one of the plenum and door plenum to the other one of the plenum and door plenum.

2. The oven of claim 1, wherein the interior insulation layer is a ceramic material.

3. The oven of claim 1, wherein the outer housing comprises stainless steel.

4. The oven of claim 1, wherein the oven core comprises stainless steel.

5. The oven of claim 1, further comprising a latch for latching the door to the outer housing.

6. The oven of claim 5, wherein the latch includes a cam style latching mechanism.

7. The oven of claim 1, wherein the door comprises a frame mounted to an inside of a vertical panel of the door, the perimeter of the frame being smaller than the perimeter of the outer housing.

8. The oven of claim 7, wherein insulation is provided in the frame of the door, and wherein the insulation in the door encloses the insulation in the oven core.

9. The oven of claim 7, wherein a fan vent is provided in the aperture formed in an upper portion of a back wall of the housing.

10. The oven of claim 1, wherein the blower is configured to evacuate air from the plenum to create a negative pressure in the plenum, the negative pressure in the plenum drawing air from the second plenum into the plenum and further drawing air through vents in the door into the second plenum.

11. The oven of claim 10, further comprising a plurality of vents placed in a first and a second side wall of the housing adjacent a top of the housing.

12. The oven of claim 10, further comprising a controller in communication with the heating element, the controller programmed to control at least one of the heating element and the blower with a proportional integral derivative control.

13. The oven of claim 10, further comprising a hood coupled to the housing, the hood including:

a horizontal flange extending above and substantially parallel with an upper surface of the housing and including a vent opening;

and a vertical flange substantially parallel with and offset from a back surface of the housing.

14. An oven comprising:

an outer housing including a back wall and at least one side wall extending from and defining an outer perimeter around the back wall of the outer housing, an aperture formed in the back wall of the outer housing;

an oven core housing received in the outer housing, the oven core housing having a back wall and at least one side wall coupled to and extending from the back wall of the oven core housing, the at least one side wall of the oven core housing defining a perimeter around the back wall of the oven core housing that is smaller than the perimeter of the outer housing, wherein a plenum is defined between the outer housing and the oven core housing, and at least a portion of the aperture formed in the back wall of the outer housing is positioned in the plenum;

a blower coupled to the outer housing adjacent the aperture, the blower inducing a fluid flow through the plenum;

an insulating layer received in the oven core housing, the insulating layer comprising at least one side wall and a back wall, the at least one side wall of the insulating layer extending along and insulating the at least one side wall of the oven core housing and the back wall of the insulating layer extending along and insulating the back wall of the oven core housing, the at least one side wall of the insulating layer having a portion extending beyond the at least one side wall of the oven core housing at an edge opposite the back wall of the oven core housing;

a heating element received on an interior surface of the insulating layer;

a door movably coupled to the at least one side wall of the outer housing opposite the back wall of the outer housing, the door configured to move between an open position providing access to an interior of the oven core housing and a closed position preventing access to the interior of the oven core housing, wherein in the closed position, the portion of the insulating layer extending beyond the at least one side wall of the oven core housing abuts the door to insulate the oven, the door including a plurality of vents in a lower portion of the door, wherein fluid flow induced by the blower is directed from one of the plenum and the vents in the door to the other one of the plenum and the vents in the door.

15. The oven of claim 14, wherein the oven includes first and second side walls and each of the first and second side walls include vents in an upper portion and a lower portion thereof, the vents in fluid communication with the plenum.

16. The oven of claim 15, wherein the side vents are located adjacent the door when the door is in a closed position.

17. The oven of claim 15, further comprising a controller in a controller housing, and wherein the controller housing comprises a vent.

18. An oven comprising:

an outer housing;

an oven core comprising an oven core housing, an interior insulation layer and a heating element, the oven core received within the outer housing;

a plenum between the outer housing and the oven core;

a blower inducing a cooling fluid flow through the plenum;

a door including a central insulated panel and a door plenum between the central insulated panel and an outer edge, wherein the door is moveable between an open and a closed position, and wherein the central insulated panel encloses the oven core and the door plenum mates with the plenum between the outer housing and the oven core when in the closed position, the door including a vent provided at a position vertically opposite the blower, wherein fluid flow from the blower is directed through the door vent and through the plenum;

a hood coupled to the housing, the hood including:

a horizontal flange extending above and substantially parallel with an upper surface of the housing and including a vent opening; and a vertical flange coupled to the horizontal flange and substantially parallel with and offset from a back surface of the housing; and a controller in communication with the blower and the heating element, the controller maintaining a temperature of the housing by monitoring a temperature of the oven and applying a proportional-integral-derivative control to the heating element.

19. The oven of claim 18, further comprising a plurality of vents formed adjacent the plenum, the plurality of vents positioned to direct fluid flow in the plenum.

20. The oven of claim 18, further comprising a latch with a cam mechanism coupled to the door and the housing.

* * * * *